United States Patent [19]

Miller et al.

[11] Patent Number: 4,505,617

[45] Date of Patent: Mar. 19, 1985

[54] STABILIZING BLUFF STRUCTURES AGAINST OSCILLATION

[75] Inventors: Donald S. Miller, Newton Blossomville; Roger King, Milton Keynes, both of England

[73] Assignee: National Research Development Corporation, London, England

[21] Appl. No.: 455,553

[22] Filed: Jan. 4, 1983

Related U.S. Application Data

[63] Continuation of Ser. No. 193,110, Oct. 2, 1980, abandoned.

[30] Foreign Application Priority Data

Oct. 12, 1979 [GB] United Kingdom ..... 7935478

[51] Int. Cl.[3] ..... E02B 17/00

[52] U.S. Cl. ..... 405/211; 405/22

[58] Field of Search ..... 405/22, 61, 62, 74, 405/211

[56] References Cited

U.S. PATENT DOCUMENTS

| | | | |
|---|---|---|---|
| 3,148,509 | 9/1964 | Laurie | 405/61 X |
| 3,193,260 | 7/1965 | Lamb | 405/61 X |
| 3,248,886 | 5/1966 | Blenkarn | 405/211 |
| 3,470,700 | 10/1969 | Quaine et al. | 405/211 |
| 3,553,968 | 1/1971 | Armistead | 405/211 |
| 3,686,887 | 8/1972 | Bruce | 405/74 X |

*Primary Examiner*—David H. Corbin

*Attorney, Agent, or Firm*—Cushman, Darby & Cushman

[57] ABSTRACT

Method and apparatus for stabilizing an upright structure such as a pile against transverse oscillation due to the relative horizontal motion of the sea past it. Gas is discharged from orifices formed either in a ring duct surrounding the pile, or in the wall of the pile itself. The bubbles tend to rise within the region of low-pressure which forms closely downstream of the pile, so breaking the synchronism of the known vortex-shedding mechanism that can promote the transverse oscillation. A perforated shroud may surround the structure and the bubbles may rise within the gap between structure and shroud. Such a shroud may itself have some stabilizing property even when the gas supply is turned off.

1 Claim, 2 Drawing Figures

STABILIZING BLUFF STRUCTURES AGAINST OSCILLATION

Figure 1:
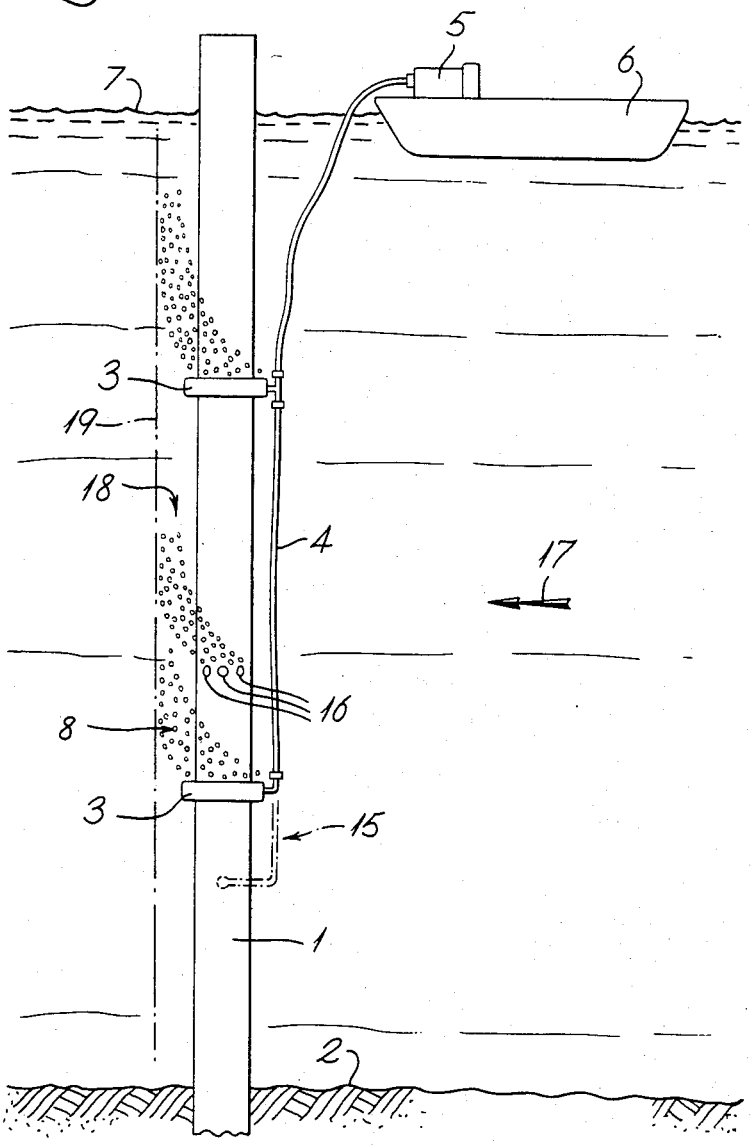

This is a continuation of application Ser. No. 193,110 filed Oct. 2, 1980, now abandoned.

This invention relates to stabilising elongated bluff—typically cylindrical—structures against oscillation, and in particular to stabilising stationary structures of this kind against being set into transverse oscillation due to the phenomenon known as vortex shedding which is caused by the relative motion between the structures and the fluid environments in which they are located. It is well known for instance that tall, lightweight chimneys and stacks are liable to be set into such vibration by the relative motion of wind, and that the relative motion of the sea can set underwater piles and the supporting legs of oil platforms and other marine structures into similar vibration. It should also be noted that the phenomenon is not only suffered by cantilever-supported structures: comparable oscillations are sometimes experienced by structures supported at opposite ends.

If such transverse oscillations occur at a frequency at which the structure resonates, the amplitude of the vibrations may grow and the structure eventually fails.

While it is usually impossible to prevent all transverse vortex shedding without modifying the shape of the structure in ways that would otherwise be unacceptable, it has become appreciated that a disastrous resonant condition can in practice be avoided by ensuring that the shedding at any one point along the length of the structure fails to synchronise with the shedding at adjacent points. Many methods of achieving this disturbance of synchronism have been proposed, and most of them have involved fitting some form of baffle to the structure: for instance various forms of shroud or cage, or the spiral "strake" protected by U.S. Pat. No. 3,076,533. Such baffles are usually unadjustable once fitted, and have the disadvantages firstly that their effect is often far less noticeable at some relative velocities of the structure and the surrounding medium than at others, and secondly that they almost always increase the normal (as opposed to the transverse) forces that the medium exerts upon the structure.

According to the present invention, means to stabilise a bluff, upright, elongated structure against transverse oscillation caused by relative motion between the structure and the surrounding fluid medium comprise means located on or close to the structure and adapted in use to release a second fluid medium of different density from the first, whereby the second fluid will be attracted to the low-pressure region that forms within the first fluid closely downstream of the structure and then rises or falls close to that region, so breaking the synchronism of vortex-shedding along the length of the structure.

Preferably the second fluid medium is less dense than the first and may be a gas while the first is a liquid.

The second medium may be discharged from points spaced around the periphery of the structure, for instance from a toroidal or other annular duct surrounding the structure. Among other possibilities are that the second medium is discharged through orifices formed in the surface of the structure itself, and that if the structure is hollow the medium may reach these orifices by way of the hollow interior of the structure.

The structure may also carry another anti-vibration device—for instance a shroud of mesh or slatted configuration—which surrounds the structure, leaving an annular gap in between, and the device which discharges the second fluid may be located closely below this device so that a substantial proportion of the gas bubbles that rise from the device enter the annular gap.

The invention is also stated by the claims at the end of this specification and will now be described, by way of example, with reference to the accompanying two drawings, which show two different applications of the invention in diagrammatic elevation.

FIG. 1 shows a plain, cylindrical pile 1 in the course of being driven, by means not shown, into the sea bed 2. Two hollow, toroidal ducts 3 are fixed to the pile, one above the other, and each is fed with compressed air by way of an air line 4 from a compressor 5 mounted on a barge 6 floating on the sea surface 7 close to pile 1. Discharge holes are formed around the upper surfaces of ducts 3, and air bubbles 8 escape through these holes. Alternatively, or in addition, air line 4 could communicate (as indicated in outline at 15) with the hollow interior of pile 1 and the bubbles could escape through holes 16 formed in the wall of the pile. Whenever there is relative horizontal motion between the sea and a structure—direction of motion of the sea relative to the pile 1 or drill pipe 12 is indicated by the arrow 17 in the drawings—the bubbles will tend to be drawn to the region of low pressure that forms close to the structure and on its downstream side. That region is indicated by reference 18 in FIG. 1, its upstream boundary being the pipe 1 and its downstream boundary being indicated diagrammatically by the broken line 19. Within this region the bubbles form what is in effect a wake which interferes with the normal process of vortex-shedding and the consequent transverse vibrations of the pile, breaking the synchronism of these vibrations along the submerged height of the pile.

Figure 2:
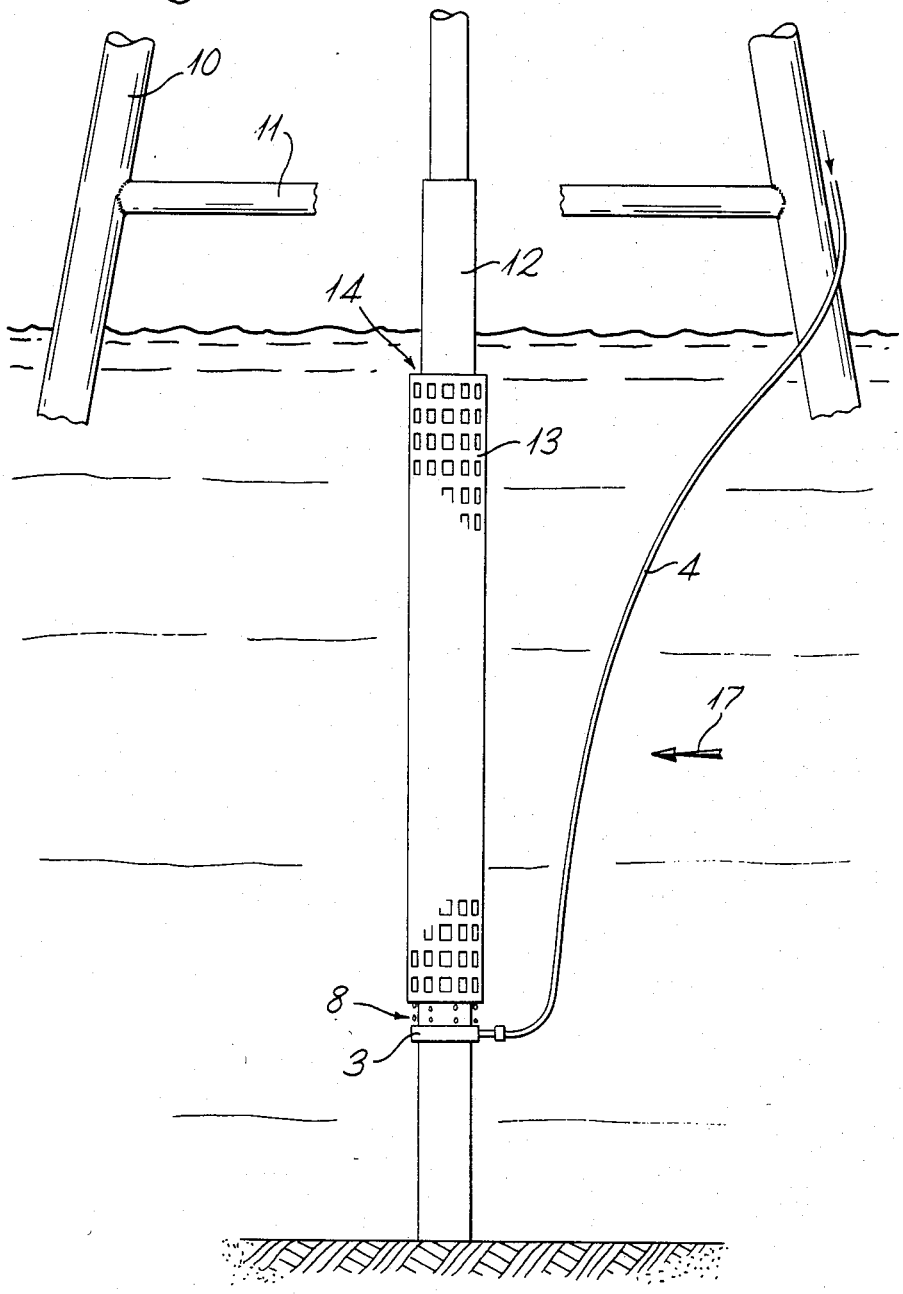

FIG. 2 shows parts of a marine oil-drilling platform including the legs 10, a cross-member 11 and the drill pipe 12 which carries a perforated shroud 13 separated from the pipe by an annular gap 14. A hollow toroidal duct 3, supplied by an air line 4 as before, is mounted around pipe 12 so that the air bubbles 8 discharged from the duct rise up the pipe 12 and a substantial proportion of them enter the gap 14 and rise within it. Both within the gap 14 and outside it, the bubbles again tend to congregate to the downstream side of the pipe when there is relative lateral motion between the pipe and the water, with the same de-synchronising effect as before.

Tests suggest that the second fluid—air in the examples just described—may be said to "decouple" the shear layers of water that would otherwise roll up into an alternate vortex street just downstream of the structure. Thus the power as well as the synchronism of the vortex-shedding would seem to be diminished. With the kind of plain pile shown in FIG. 1 tests have shown that if the pile is say two inches in diameter and four feet long, and exposed to a water flow rate of up to three feet per second, substantial protection against transverse oscillation can be obtained by blowing air through two ducts at a supply pressure of up to 5 psi gauge. With such test dimensions, it was found difficult to obtain useful protection with only a single duct 3. With the alternative arrangement as shown in FIG. 2, in which a shroud surrounds the structure, without the use of this invention it is common practice to surround almost the entire of the under-water length of the structure with shroud and to design the latter to match the greatest water velocity which the structure may have to withstand. Use of the present invention suggests the economy of using a shorter length of shroud, which will be adequate for moderate water velocities, and only turning on the air supply to give added protection when that velocity rises higher.

While devices as described to create bubbles of water around fixed, underwater structures are an obvious application of this invention, its scope is not limited to them. For example it could apply also to devices to stabilise the periscopes of submarines moving through still water, and the possibility is foreseen of discharging a second fluid medium heavier than the first from a point high up the structure so that it falls down it instead of rising up.

What is claimed is:

1. A method of stablising a bluff, upright rigid structure of substantial length fixed at at least one of the ends of said length to a stationary supporting surface, the structure being exposed in use to substantial relative motion of a first fluid medium in a direction transverse to the length of the structure, said relative motion being such as to give rise to a low pressure region down stream of the structure and causing substantial transverse oscillation of the structure, the method comprising the steps of selecting an outlet means for a second fluid medium in the form of an annular member, placing the annular member around but spaced from said structure so as to encompass said structure at a selected height above the supporting surface, releasing from said annular member the second fluid medium with said annular member being itself free of any encompassment, so that said second medium when so released is free to move transversely away from said rigid structure and will be attracted to said low pressure region, so breaking the synchronism of vortex-shedding along the length of said structure that causes said transverse oscillation.

* * * * *